US005323678A

United States Patent [19]

Yould

[11] Patent Number: 5,323,678

[45] Date of Patent: Jun. 28, 1994

[54] HAND-HELD PERCUSSION MUSICAL INSTRUMENT COMPRISING ELONGATE TUBE SHAPED AS A RING, INCORPORATING DIVIDERS, AND INCOPORATING CONTAINED SOUND-GENERATING ELEMENTS

[75] Inventor: Kenneth D. Yould, Palm Springs, Calif.

[73] Assignee: Triamid Corporation, Palm Springs, Calif.

[21] Appl. No.: 922,808

[22] Filed: Jul. 31, 1992

Related U.S. Application Data

[63] Continuation-in-part of Ser. No. 746,789, Aug. 15, 1991.

[51] Int. Cl.[5] ..... G10D 13/06

[52] U.S. Cl. ..... 84/418; 84/743

[58] Field of Search ..... 84/418, 420, 402, 723, 84/743

[56] References Cited

U.S. PATENT DOCUMENTS

| | | | |
|---|---|---|---|
| 4,165,671 | 8/1979 | De Bose | 84/402 |
| 4,168,064 | 9/1979 | Petrovic | 84/420 X |
| 4,179,973 | 12/1979 | White | 84/402 |
| 4,306,485 | 12/1981 | Rudkin | 84/402 |
| 4,858,510 | 8/1989 | Shimoda et al. | 84/402 |

*Primary Examiner*—William M. Shoop, Jr.
*Assistant Examiner*—Jeffrey W. Donels
*Attorney, Agent, or Firm*—Richard L. Gausewitz

[57] ABSTRACT

Disclosed is a hand-held percussion musical instrument in the form of a rigid tubular ring, which includes a plurality of elongate hollow tubes, the tubes having rigid tubular walls and opposite end walls defining closed hollow tube interiors. Steel shot is loosely contained within the hollow interiors of the tubes, whereby the ring may be hand manipulated to cause the shot to impact the walls to create audible percussion sounds.

17 Claims, 4 Drawing Sheets

FIG. 8.
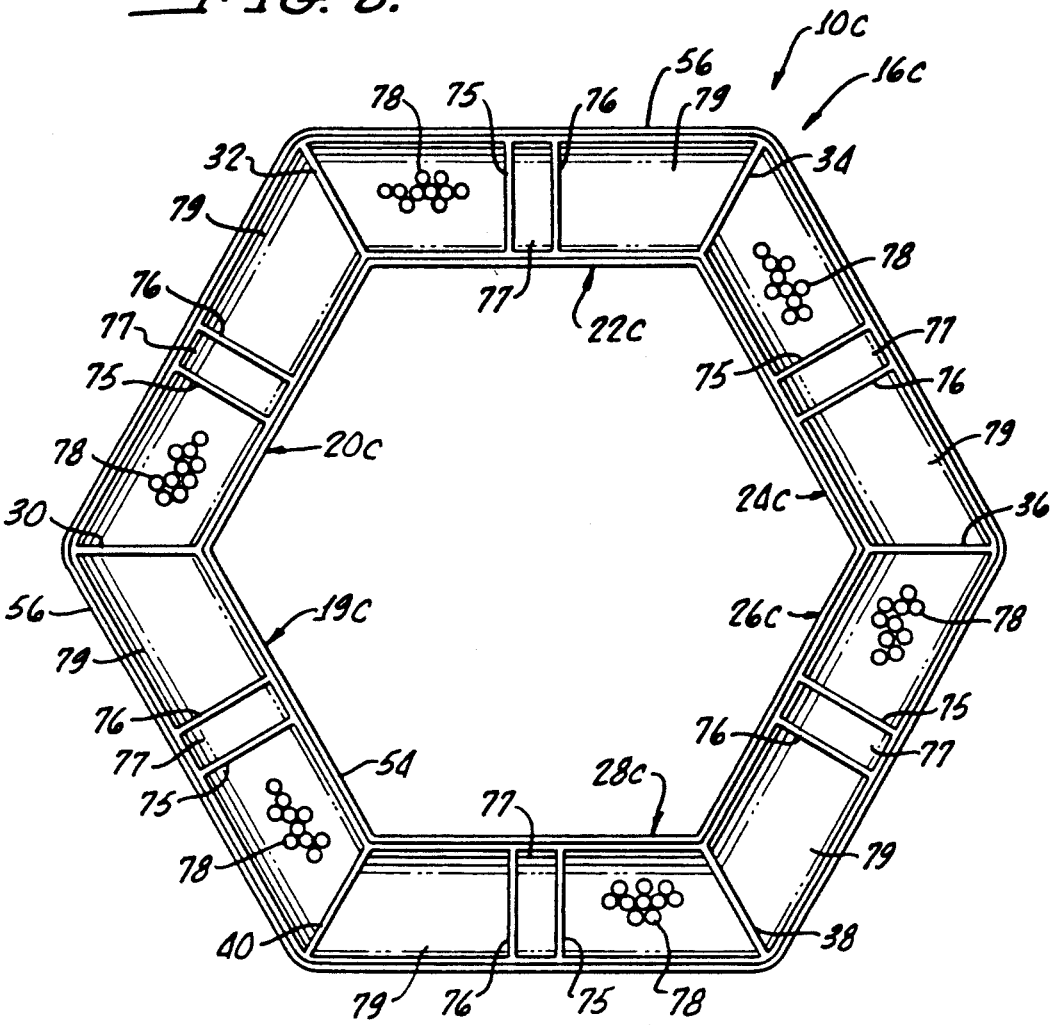
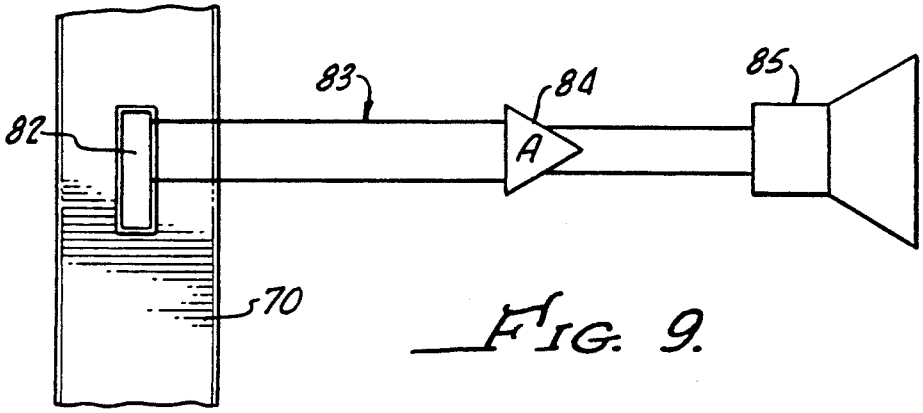
FIG. 9.

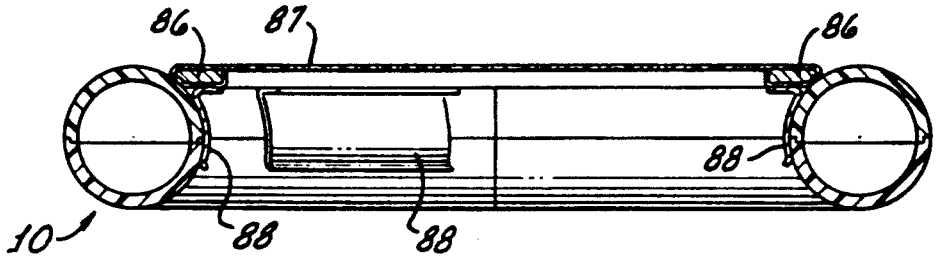
FIG. 10.
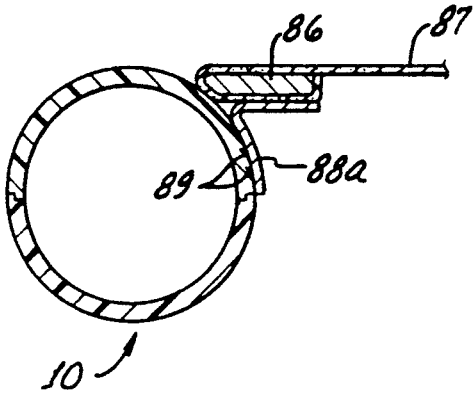
FIG. 11.
FIG. 12.
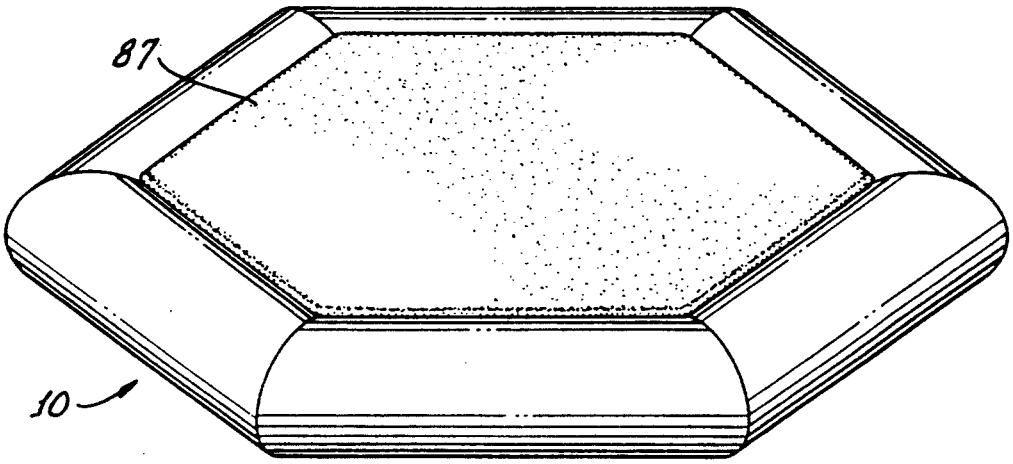

HAND-HELD PERCUSSION MUSICAL INSTRUMENT COMPRISING ELONGATE TUBE SHAPED AS A RING, INCORPORATING DIVIDERS, AND INCOPORATING CONTAINED SOUND-GENERATING ELEMENTS

CROSS REFERENCE TO RELATED APPLICATION

This is a continuation-in-part of application Ser. No. 07/746,789, filed Aug. 15, 1991, for Percussion Musical Instrument.

FIELD OF THE INVENTION

This invention relates to hand-held percussion musical instruments for use by a performer to lend percussion sound emphasis to music, singing and/or dancing.

BACKGROUND OF THE INVENTION

Examples of percussion musical instruments designed to be held in one hand by a performer for lending motion and percussion sound emphasis to music, singing and/or dancing include the tambourine and the maraca. Typically the tambourine is a shallow one-headed drum with loose metallic discs at the sides and which is played by shaking, striking with the hand, or striking the instrument against other portions of the body. The typical maraca is a dried gourd or the like, as on a handle, the gourd being hollow and containing dried seeds or pebbles. In either case, such conventional instruments may be held in one hand and are used to lend emphasis to the body and arm movements of a singer or dancer, as well as to lend percussion sound emphasis to music whether or not accompanied by visual body movements of a singer or dancer.

The instrument of the present invention, albeit different in material respects, falls within this same general class of percussion instruments.

Accordingly, the principal object of the present invention is to provide a new and unique hand-held musical percussion instrument, also suitable as an attractive prop for a singer or dancer, and which is convenient to manipulate and capable of producing unique percussion sounds and sound combinations.

SUMMARY OF THE INVENTION

The percussion musical instrument comprises a hard elongate tube that is, in effect, bent upon itself so as to form a closed figure. The tube contains masses of relatively hard substance, such as steel, that impact against the tube wall and generates percussive sounds. Interior walls divide the tube into chambers, and the walls act as soundboards for the hard masses.

In accordance with one aspect of the present invention, a hand-held percussion musical instrument is formed as a rigid tubular ring having an external diameter within a range of about 7 to about 12 inches. The ring includes a plurality of at least 5 or more elongate hollow tubes connected end-to-end, with each tube having a rigid tubular wall and rigid opposite end walls defining a closed hollow tube interior. Loosely contained within the hollow interior of a plurality of said tubes are the plurality of relatively small hard solid masses, whereby the instrument may be hand-held and manipulated so as to cause the solid masses to impact the tubular walls, end walls and each other to create audible percussion sounds, and whereby the instrument may be used to accompany and lend emphasis to singing and/or dancing.

In the preferred embodiment of the invention, the elongate tubes are approximately straight and connected end-to-end as a polygon configured ring, with the tubular walls being sufficiently thin, hard and rigid to act as soundboards for acoustically coupling induced vibrations from said solid masses audibly to the external surrounding atmosphere. The most favorable construction utilizes at least six similar hollow tubes connected together to form a regular hexagon.

Also in the preferred embodiment of the invention, the rigid tubular ring is formed primarily of injection molded hard and rigid plastic material, such as polycarbonate or acrylic plastic. The tubular walls are approximately circular in cross-section about central axes approximately in the same median plane, and the tubular ring is formed in an upper half and lower half having interlocking mating surfaces which extend about the full circumference of the ring and join approximately in such median plane which approximately bisects the ring along and through its entire circumference.

In the preferred embodiment of the invention, the solid masses are metallic and approximately spherical with the diameter of the majority of such masses being within the range of about 1/16 inches to about 4/8 inches; and, the tubular walls and end walls have smooth surfaces with the tubular walls having an external diameter within a range of about 1 to about 1¾ inches, and a wall thickness of about 1/16 to about 3/16 inches.

Through selection of the ring configuration and materials, as well as the tube lengths, diameters and wall thicknesses, as well as the size and nature of the solid masses loosely contained in the tubes and the number and distribution of such solid masses among the tubes, different percussion effects, and differently-pitched tones, can be achieved. A plural set of differently-tuned such instruments can be provided to the performer for selection and use in accompanying different musical renditions and dance routines.

In one embodiment, mechanical-electrical transducers are associated with the ring and with amplifiers and loudspeakers.

In another embodiment, the ring and contained masses is combined with a drum rim and drumhead, thereby forming a composite percussive instrument capable of a variety of percussive effects.

BRIEF DESCRIPTION OF THE DRAWINGS

The foregoing and other aspects of the present invention will be better understood by reference to the following detailed description of the preferred and other embodiments thereof, made with reference to the accompanying drawings, in which:

FIG. 8 is a plan view similar to FIGS. 2 and 6, but showing the lower half of an embodiment of the present invention in which empty sound chambers are provided between those chambers which contain solid masses;

FIG. 9 is a fragmentary plan view, partially schematic, illustrating an embodiment of the invention in which electrical amplifier and loudspeaker means are provided in association with the present musical instrument;

FIG. 10 is a vertical sectional view illustrating an embodiment of the invention in which a drumhead and associated rim or frame are mounted fixedly on the above-described percussion instrument, thereby providing a composite instrument having unusual characteristics and numerous capabilities;

FIG. 11 is an enlarged view of one side of FIG. 10, and showing a modified way of mounting the drumhead; and FIG. 12 is an isometric view of the embodiment of FIG. 10.

DETAILED DESCRIPTION OF THE PREFERRED EMBODIMENT

Figure 1:
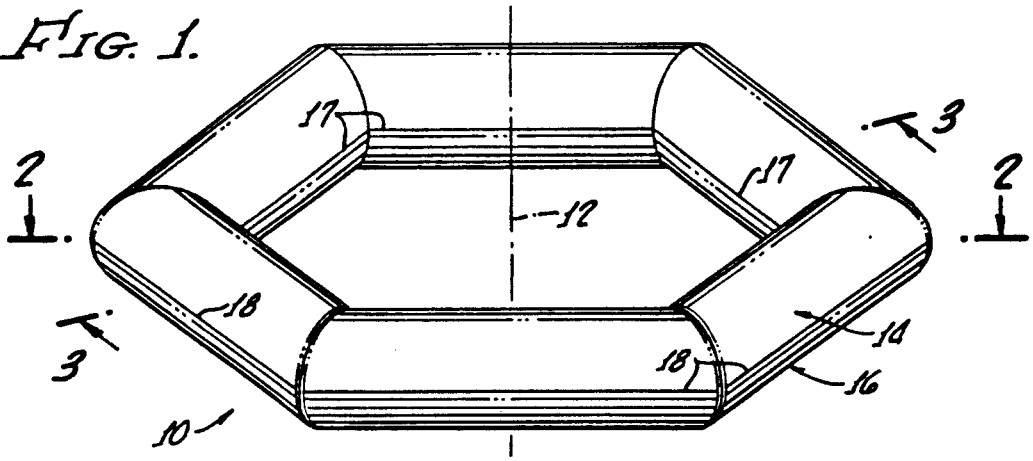
FIG. 1 is an external perspective view of the preferred embodiment of the instrument of the invention.
Figure 2:
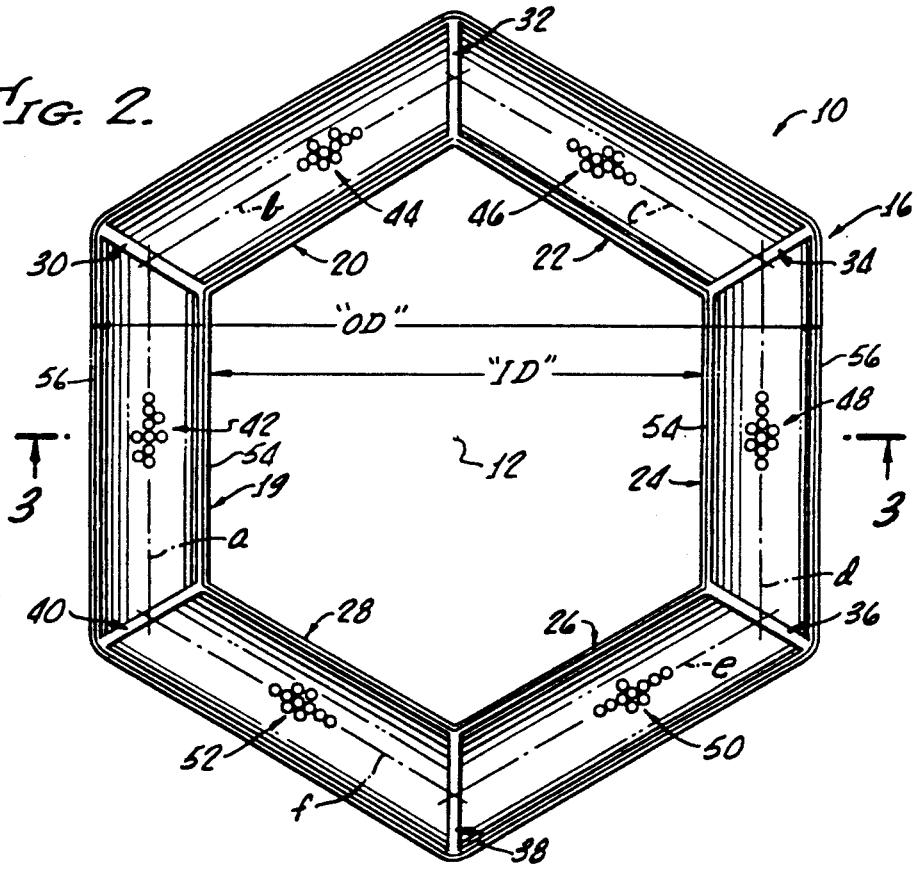
FIG. 2 is a view of only the lower half of the instrument of FIG. 1, showing various solid masses loosely resting therein, the view being taken generally along line 2—2 of FIG. 1 in the median plane which approximately bisects the tubular ring through its circumference.
Figure 3:
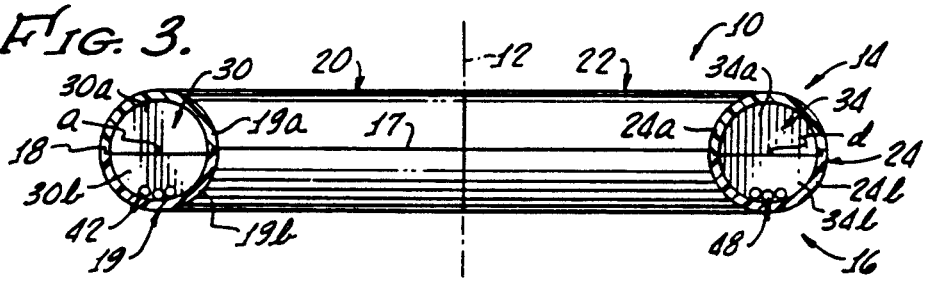
FIG. 3 is a cross-section taken along line 3—3 of FIGS. 1 and 2, but shown as if the entire instrument were assembled as depicted in FIG. 1 with the upper and lower ring halves joined.
Figure 4:
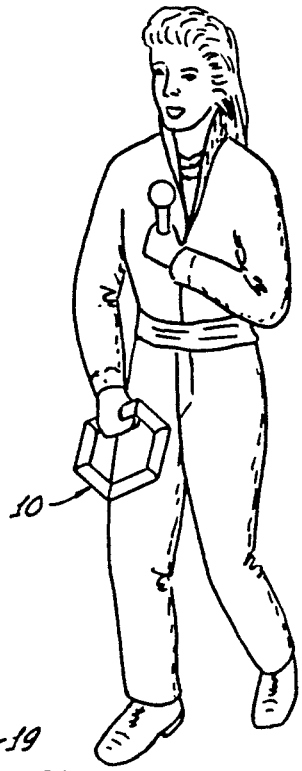
FIG. 4 schematically depicts a performer holding a microphone in the left hand and the instrument of the invention in the right hand, having just struck the instrument against the right leg.

Referring now to FIGS. 1-3, the hand-held percussion musical instrument is structurally defined in major part as a rigid tubular ring 10 about a central axis 12 by an upper ring half 14 and a lower ring half 16 which join together about the full circumference of the ring in a median plane which is approximately coincident with the inner and outer circumferential lines of joinder 17,18 (FIG. 1) between the upper and lower halves 14,16, such that the median plane approximately bisects the ring 10 along and through its total circumference.

The tubular ring 10 is in the form of a regular hexagon and includes six identical, straight elongate hollow tubes respectively defined by smooth tubular walls 19,20,22,24,26,28 (FIG. 2) of circular cross-section each about a separate central longitudinal tube axis a, b, c, d, e, and f, respectively. Common end walls 30,32,34,36,38,40 close the opposite ends of the hollow tubes, with the tubes thereby each having a separate hollow interior. The hollow tubes are effectively connected end-to-end adjacent the end walls to form the hexagonal tubular ring 10. Stated in another manner, the tubular member bends upon itself to form a closed figure, such as a hexagon.

As best seen in FIG. 2, contained within the separate hollow tubes defined by the smooth tubular walls 19,20,22,24,26,28, respectively, are separate pluralities 42,44,46,48,50,52, of metallic steel shot, each pellet of steel shot being approximately spherical.

The upper and lower halves 14,16 of the tubular ring are each formed in a single piece by injection molding of a hard, rigid plastic material such as polycarbonate or acrylic plastic. Steel shot is first introduced in the open bottom ring half 16, the mating surfaces of the upper and lower ring halves are then wetted with a conventional volatile solvent for the plastic selected, and the two ring halves are then pressed together so that their mating surfaces weld together. Upon drying, the rigid tubular polygonal ring is thus formed, loosely containing shot within the hollow interiors of the tubes.

Figure 5:
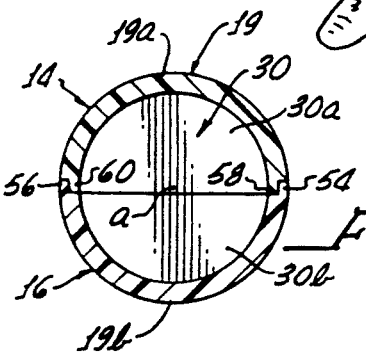
FIG. 5 is an enlarged cross-section of a typical tube, and which better illustrates the nature of the interlocking mating surfaces of the top and bottom halves of the instrument, the enlargement being of the left tubular cross-section shown in FIG. 3.

Thus, as best seen in FIGS. 3 and 5, a typically tubular wall 19 is formed in an upper tubular wall half **19*a* and a mating lower tubular wall half 19*b*; and, typically, end wall 30 is formed in an upper end wall half 30*a* and a mating lower end wall half 30*b*. Similarly, tubular wall 24 has an upper half 24*a* and a mating lower half 24*b*; and, end wall 34 has an upper half 34*a* and a mating lower half 34*b*. The upper halves of the tubular walls and the upper halves of the end walls all are formed integrally in the upper ring half 14; and the mating lower halves of the tubular walls and mating lower halves of the end walls all are formed integrally in the lower ring half 16**.

The mating surfaces of the tubular walls extend continuously around the inner and outer circumference of the tubular ring 10. As seen in FIG. 5, the lower ring half 16 has outer upwardly extending lips, flanges or tangs 54 and 56 of half wall thickness; and, the upper ring half 14 has inner downwardly extending lips, flanges or tangs 58 and 60 of half wall thickness which fit between the outer tangs 54,56 of the lower ring half 16, thus providing interlocking mating surfaces for the upper and lower tubular walls extending around ring 10.

Also as seen in FIG. 5, the typical end wall halves **30*a* and 30*b* have mating surfaces which abut each other, as indicated by the joinder line extending across the interior of the composite tubular wall 19** through the tube axis a.

Figure 6:
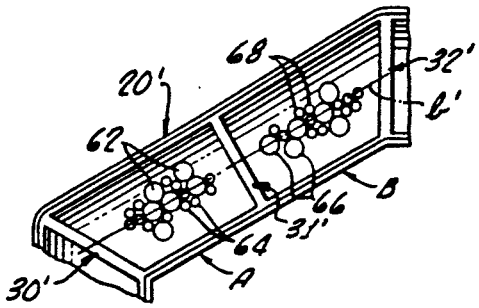
FIG. 6 is a variation of the embodiment of the invention shown in FIGS. 1-3, illustrating how a typical tube may be modified by introducing an intermediate end wall, such that the hexagon shown in FIGS. 1-3 could incorporate twelve separate tubes for different sonic effects.

A variation to achieve different sonic effects is illustrated in FIG. 6 which illustrates a variation of the top left tube shown in FIG. 2, to which a prime mark has been added to common reference numerals; e.g., 20' for the tubular wall extending between end walls 30' and 32' along central axis b'. However, in FIG. 6, an intermediate end wall 31' is added half way between end walls 30' and 32', thus dividing the tubular wall 20' into two coaxial aligned tubes A and B about axis b'. Contained within the first tube A are a plurality of relatively large steel shot shown typically at 62, as well as a plurality of relatively small steel shot shown typically at 64. Similarly, the second tube B, as defined between the end walls 31' and 32', loosely contains a plurality of relatively large diameter steel shot typified at 66, together with a plurality of relatively small diameter steel shot typified at 68. This variation can be applied to all of the tubes depicted in FIGS. 1 to 3 which would result in a tubular hexagon comprising twelve separate tubes connected end-to-end adjacent their end walls. Such variation would achieve a different sonic effect and react differently to hand manipulation of the tubular ring.

Figure 7:
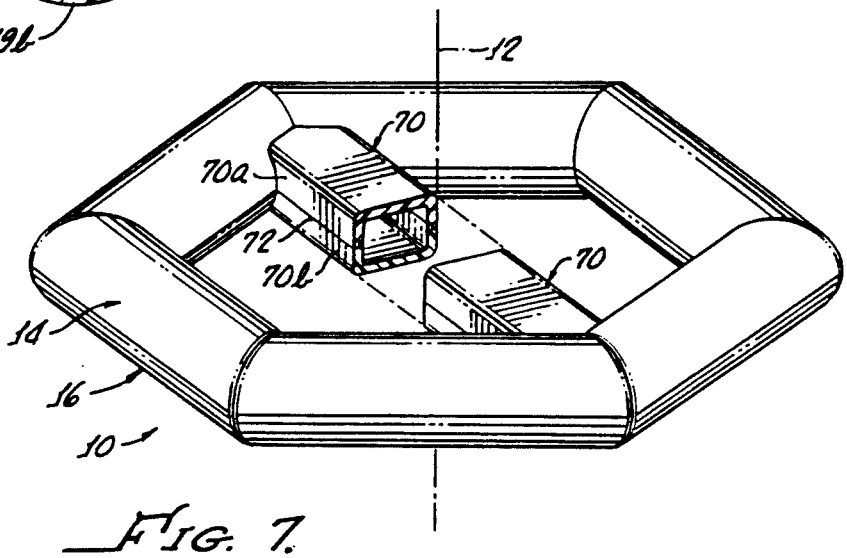
FIG. 7 is a variation of the preferred embodiment of the invention which incorporates a diametric cross-handle suitable for grasping and conveniently rotating the tubular ring directly about its own central axis for sonic effect.

Another construction variation for the tubular ring 10 is illustrated in FIG. 7. In this variation, a cross-handle 70 extends across the internal diameter of the ring 10 between opposite apexes of the regular hexagon. The upper half of the cross-handle 70a is formed integrally with the upper ring half 14, and the lower half 70b of the cross-handle is formed integrally with the lower ring half 16, with the upper and lower cross handle halves 70a,70b, having mating surfaces which are welded together as in the case of the construction of the ring itself as previously described, such mating surfaces being generally indicated by the joinder line 72. As shown, the cross-handle 70 is hollow, and is useful for the mounting and isolation of various accessories.

By grasping the cross-handle 70, the performer may directly rotate the ring 10 about its central axis 12 conveniently to achieve a variation in the sonic effect.

In the embodiment of the invention illustrated in FIGS. 1-3, the tubular hexagon ring 10 has an outer diameter "OD" (as measured directly between opposite flats of the hexagon) of 9 inches, and has an internal diameter "ID" (as measured between opposite flats of the hexagon) of 6 inches. The tubular walls each have an external diameter of 1½ inches, and a wall thickness of 3/32 inches. Of course, measured apex-to-apex of the hexagon, the outer ring diameter would be slightly greater, this being the maximum external diameter of the ring.

Generally, it is found that the maximum external diameter of the ring should be within a range of about 7 to about 12 inches, and the external diameter of the tubular walls should be within a range of about 1 to about 1¾ inches, with a wall thickness within a range of about 1/16 inches to about 3/16 inches, while the steel shot may be of mixed diameters. Best results are obtained when the majority of such metallic steel shot (masses) have diameters within a range of about 1/16 inches to 4/8 inches. For example, the steel shot illustrated in FIG. 2 is all of the same diameter, about ⅛ inch; the steel shot illustrated in FIG. 6 would include for each tubular chamber A and B a 50/50 mixture of ⅛ inch diameter steel shot and ¼ inch diameter steel shot.

By the choice of dimensions, materials, wall thickness and diameters, as well as by the specific placement of end walls, different sonic effects can be achieved using the percussion instrument. The instrument can be constructed of separate pieces rigidly connected together, some of which could have a curvature (e.g., the tubes), and may even be constructed of thin metal, (e.g., thin metallic tubular walls).

Preferably, however, the tubular ring is injection molded in two halves as described from hard rigid plastic material such as polycarbonate or acrylic plastic, so as to (1) provide a durable structure that will withstand pounding, and (2) so as to achieve good common soundboard effects for the tubular walls in audibly coupling induced percussion vibrations from the loosely contained hard masses to the surrounding atmosphere. Steel shot is preferred. However, other metals may be employed, and hard non-metallic masses may be used.

One aspect of the invention that facilitates utility and variations is that the individual hollow tubes are contained in a rigid ring, and their longitudinal axes while generally in the same plane extend in different directions in that plane. At least five such hollow tubes are preferred, whether the ring is a circle, a polygon, or a hybrid of the two in general configuration. Thus, for example, the ring may be a pentagon or an octagon as well as a hexagon.

The Embodiment of FIG. 8

Except as specifically stated herein, the embodiment of FIG. 8 is structurally identical to that of FIGS. 1-5. Some of the parts shown in FIG. 8 are given the same reference numerals as in FIG. 2, except followed by the letter "c".

It is to be understood that FIG. 8 shows only the lower half of the present embodiment of the musical instrument, in this respect corresponding to FIG. 2 which shows the first embodiment. Also, it is to be understood that, except as specifically noted below, FIGS. 1 and 3 apply relative to the embodiment of FIG. 8 just as they apply relative to the embodiment of FIG. 2. Thus, there is an upper half of the present embodiment that fits over and is connected to the lower half shown in FIG. 8. Such upper half is the mirror image, about the median plane, of what is shown in FIG. 8, except at lips, flanges or tangs 54,56,58 and 60 (these being as shown in FIG. 5). Also, for example, each end wall in the lower half has a corresponding end wall in the upper half, and these fit together when the apparatus is assembled as shown in FIGS. 1 and 3 to form complete end walls that isolate each plurality of shot in its particular chamber, and that act as soundboards.

As shown in FIG. 8, there are provided in each of the tubes two baffle or sound-chamber-defining walls 75,76 spaced a substantial distance from each other. In the illustrated embodiment, the walls 75,76 in each tube are spaced approximately ½ inch from each other. The walls 75,76 are centered in their respective tubes, so that a plane midway between the two baffle walls 75,76 in each set thereof is also midway between the associated end walls such as 30-32,32-34,34-36,36-38 and 38-40.

Because, as stated above, the upper half of the present embodiment is (substantially) the mirror image of what is shown in FIG. 8, it accordingly has baffle walls that correspond to and meet at their edges with the illustrated baffle walls 75,76. There are thus formed closed chambers 77 between the respective baffle walls 75,76, etc. These closed chambers act as sound chambers and do not contain shot, etc.

Shot or other sound-generating masses are provided in some or all of the remaining chambers of the embodiment of FIG. 8. In the illustrated preferred form, shot 78 is provided in each alternate large chamber, that is to say the chamber between a baffle wall 75 and an end wall 30, between the next baffle wall 75 and an end wall 40, etc.

It is to be understood that the statements made above relative to varying the diameters and types of solid sound-making masses, and the materials of which they are formed, apply here also.

The remaining alternate large chambers in FIG. 8, numbered 79 and not between baffle walls 75,76 but which do not contain sound-making substances (in the illustrated preferred embodiment), cooperate with the chambers 77 in acting as sound chambers.

It is emphasized that each sound chamber 77, and each empty large chamber 79 (also acting as a sound chamber), has a plurality of units of shot, etc., next to it. Accordingly, it has one wall that is directly engaged by the shot, etc., when the instrument is moved, shaken, struck, etc. Such one wall acts as a soundboard.

The relative sizes of chambers 77 and 79, and of the chambers containing shot, may be varied in order to achieve different sounds. For example, each chamber 77 may be caused to be larger than each adjacent chamber 79, or may be the same size. Various combinations of chamber sizes, shot sizes, "shot" types and mixtures, etc., may be employed for achievement of a wide variety of different sounds.

It is also to be understood that the thicknesses of the baffle walls 75,76, and the thickness of the end walls 30, etc., may be varied for achievement of different effects.

The dead-sound spaces or chambers 76 and 79 create sound amplification when the instrument is moved. The wall thicknesses and baffle thicknesses may be such that, in combination with particular shot (solid mass) sizes and types, the tones generated by the instrument are relatively bass.

The interlocking lips, flanges or tangs 56, etc., of the upper and lower halves, and the touching (at the median plane) of the edges of the baffle walls and end walls to each other, aid in the creation of full tones.

Embodiment of FIG. 9

For enhanced effects, one or more miniature microphones may be mounted on the tubular ring for direct electrical pick-up of the induced percussion vibrations, with the resulting electrical signal being processed through suitable filters and amplifiers and conducted to a speaker system.

In the preferred amplifier embodiment, the construction of FIG. 7 is employed, and the cross-handle 70 is utilized to mount internally thereof a mechanical-electrical transducer or pickup 82 as shown schematically in FIG. 9. Transducer 82 is caused to be in close rigid contact (close coupled) with the interior surface of cross-handle 70 so that vibrations from such handle—as transmitted thereto from the various chambers of the instrument through the walls thereof—are sensed by the transducer to generate electrical signals. The signals are passed through a cord or cable 83 to an amplifier 84 and loudspeaker 85 as shown in FIG. 9. The place where the transducer was inserted into the handle is a slot the dimensions of which are about ½ inch by ¼ inch, which slot is sealed after the cord or cable has passed therethrough.

With the construction of FIG. 9, the capabilities of the invention are extended even further. For example, all of the "shot" employed in the various chambers is, in one embodiment, caused to be hard synthetic resin instead of metallic. The soft sound generated by such synthetic-resin "shot" is nevertheless sensed by the transducer 82, amplified by amplifier 84 and converted to sound by loudspeaker 85, with resulting excellent musical effect.

Embodiment of FIGS. 10–12

In FIGS. 10–12 there is shown a rigid rim or frame 86, preferably formed of strong metal, across which is stretched in tensioned relationship a drumhead 87. Frame 86 is shaped correspondingly to the shape of ring 10, and has a corresponding size. Thus, in the illustrated embodiment, frame 86 is hexagonally shaped, and the periphery of drumhead 87 is a hexagon that is fixedly associated with the rim or frame 86. Frame 86 and drumhead 87 are acousticly related to the ring 10, by making the frame 86 rigidly associated with such ring.

In the preferred embodiment, rim 86 is caused to have stiff resilient clips 88 that extend downwardly therefrom, the clips being circumferentially spaced about the ring 10. Clips 88 are curved correspondingly to the downward curvature of the ring, namely cylindrical in the illustrated embodiment. The clips extend down far enough to snap over center, and thus snap into place and stay there.

It is to be understood that different types of drumheads and frames may be provided and used in place of the one illustrated in FIGS. 10 and 11. In FIG. 11, the clips 88*a* are less long than those of FIG. 10. They have barbs 89 that penetrate the plastic of the ring, and hold the clips in place.

In using the musical instrument of FIGS. 10 and 11, the instrument is held by one hand of the musician, and the drumhead is struck—typically—by the palm of the other hand of the musician. Alternatively, the drumhead may be stuck by a drumstick. Furthermore, the musician may strike the composite instrument against her or his elbow, knee, etc., to create a jarring action. In all cases, there is a combination of the sound effect made by the shot-containing ring 10 and that made by the drumhead and frame 86–87, to generate a variety of musically pleasing and unusual sounds.

Additional Disclosure and Emphasis

The present musical instrument, for example in the form shown in FIG. 7, may be incorporated into a hi-hat musical instrument so as to be played by (for example) manipulating the foot of the musician. Thus, the upper end of the rod of the hi-hat is rigidly secured to the center of the handle 70 shown in FIG. 7, with the ring 10 being in a horizontal plane and having its axis at the rod of the hi-hat. The musician then repeatedly presses on the pedal portion of the hi-hat to shake the present musical instrument vertically, it being understood that the instrument comes to a sudden stop when the pedal reaches either end of its stoke. Thus, without employing her or his hands, the musician may play the present musical instrument.

In accordance with another aspect of the construction, the hi-hat may (preferably) have a relatively short vertical dimension, and the drumhead-ring combination of FIGS. 10 and 11 is mounted on the rod of the hi-hat.

The center handle 70 of FIG. 7 may be replaced by a specific (dedicated) hi-hat mount. These two elements may be made interchangeable relative to a particular ring 10, means being provided to hold them in place relative to the ring. When the specific hi-hat mount is provided, such mount and the associated ring are mounted on the stem of the hi-hat, following which the hi-hat is operated either by using the foot pedal or by using a drumstick to hit the drumhead and/or ring.

The dead-sound spaces or chambers between end walls or baffles separate the shot-containing chambers by specific distances. The results are good amplification and pleasing sounds. The stated wall thicknesses and separator (baffle) thicknesses can achieve relatively bass tones from the instrument. The specific sizes and weights of shot, react with the sound chambers and dead-sound chambers to create different sounds and/or tones. The locking lips, flanges or tangs 54,56,58,60, and the touching together of the internal end walls, etc., create full tones.

The invention therefore is quite versatile and the scope thereof is not intended to be limited by the specific embodiments illustrated, but only by the scope of the appended claims.

I claim:

1. A hand-held percussion musical instrument, comprising:

(a) structural means defining a rigid tubular ring having an external diameter in a range of about 7 to about 12 inches, said ring including a plurality of at least five elongate hollow tubes connected end-to-end, with each tube having a rigid tubular wall and rigid opposite end walls defining a closed hollow tube interior, and (b) a plurality of hard solid masses loosely contained within said hollow interior of each of a plurality of said tubes, whereby the instrument may be hand-held and manipulated so as to cause the solid masses to impact the tubular walls and end walls to create audible percussion sounds, and may be conveniently used as an attractive instrument to accompany and lend emphasis to singing and/or dancing.

2. The apparatus of claim 1, wherein said elongate tubes are approximately straight and are connected end-to-end as a polygon-configured tubular ring, with said tubular walls being sufficiently thin, hard and rigid to act as soundboards for acoustically coupling induced vibrations from said solid masses audibly to the surrounding atmosphere.

3. The apparatus of claim 2, wherein said tubular ring is in the form of a regular hexagon.

4. The apparatus of claim 2, wherein said rigid tubular ring is formed principally of injection molded hard and rigid plastic material, such as polycarbonate or acrylic plastic, or the equivalent.

5. The apparatus of claim 4, wherein said tubular walls are approximately circular in cross-section about central axes and have an external diameter within a range of about 1 to about 1¾ inches, with a tubular wall thickness within a range of about 1/16 to about 3/16 inches.

6. The apparatus of claim 5, wherein said rigid tubular ring is formed in an upper unitary half and a lower unitary half having interlocking mating surfaces which join in a median plane, said plane bisecting said ring along and through its circumference.

7. The apparatus of claim 2, wherein said solid masses are metallic masses and are spherical.

8. The apparatus of claim 5, wherein said masses are metallic, and are approximately spherical, and the diameters of the majority of said masses are within a range of about 1/16 to about 4/8 inches.

9. The apparatus of claim 8, wherein said tubular walls and end walls have smooth surfaces.

10. A percussion musical instrument, which comprises:

(a) wall means to define a tube that bends upon itself so as to be a closed figure, said wall means being formed of a hard substance having such characteristics, and being sufficiently thin, that when hard solid masses are disposed loosely within said tube, and said tube is shaken, percussion vibrations will be created in the air surrounding said tube due to the impacting of said masses on said wall means, the diameter of said closed figure being sufficiently small that said closed figure is readily lifted and shaken by one hand of a performer, and being sufficiently large that said one hand may at different times grasp said tube at several nonoverlapping regions therealong, the diameter of said tube being sufficiently small that said tube may be readily grasped by said one hand, (b) divider means provided at spaced points along said tube to divide the length of said tube into chambers at least some of which are adapted to contain hard solid masses, (c) hard solid masses loosely disposed in at least some of said chambers to impact said wall means and create said audible percussion vibrations when said tube is shaken by said one hand, (d) a mechanical-electrical transducer is associated with said wall means to generate an electric signal in response to impacting of said masses on said wall means, and (e) amplifier and loudspeaker means connected to said transducer to convert said signal into amplified sound.

11. A percussion musical instrument, which comprises:

(a) wall means to define at least one chamber adapted to contain hard solid masses, said wall means being sufficiently small to be readily grasped, lifted and shaken by one hand of a performer, (b) hard solid masses disposed loosely in said chamber, said wall means and said masses being so constructed and related that shaking of said wall means by said one hand of said performer causes said masses to impact said wall means and generate sound that is audible to said performer and others, and (c) drumhead means mounted adjacent said wall means and connected thereto, said drumhead means and wall means being so constructed and related to each other that striking of said drumhead means by the other hand of said performer creates combined sounds, one by said drumhead means, and one by said above-stated impacting of said wall means by said masses.

12. The invention as claimed in claim 11, in which said wall means is shaped as a closed figure having an opening defined thereby, and in which said drumhead means is provided across said opening.

13. The invention as claimed in claim 12, in which said wall means and drumhead means are disposed parallel to each other.

14. The invention as claimed in claim 11, in which said wall means is a tube formed of hard synthetic resin, said tube being bent into a closed figure, and in which said masses are disposed in said tube.

15. The invention as claimed in claim 14, in which a plurality of walls are provided internally of said tube at spaced points therealong to divide said tube into a plurality of tubes, said tubes defining at least said one chamber adapted to contain said masses.

16. The invention as claimed in claim 14, in which said drumhead means is a rigid rim across which a flexible drumhead is stretched under tension, and in which means are provided to fixedly mount said rim on said tube of hard synthetic resin.

17. A percussion musical instrument, which comprises:

(a) wall means to define an elongate tube said wall means being formed of hard synthetic resin having such characteristics, and being sufficiently thin, that when hard solid masses are disposed loosely within said tube, and said tube is shaken, audible percussion vibrations will be created in the air surrounding said tube due to the impacting of said masses on said wall means, the diameter of said tube being sufficiently small that said tube may be readily grasped by one hand of a musician, (b) divider means provided at spaced points along said tube to divide the length of said tube into chambers at least some of which are adapted to contain hard solid masses, and (c) hard solid masses loosely disposed in at least some of said chambers to impact said wall means and said divider means and create said audible percussion vibrations when said tube is shaken by said one hand.

* * * * *